US005522526A

United States Patent [19]

DeLaforcade et al.

[11] Patent Number: 5,522,526

[45] Date of Patent: Jun. 4, 1996

[54] METHOD AND DEVICE FOR DISPENSING AND PACKAGING A FLUID PRODUCT CONTAINED IN A RECEPTACLE WHICH IS PRESSURIZED WITH THE AID OF A PROPELLANT GAS

[75] Inventors: Vincent DeLaforcade, Rambouillet; Pierre Lasserre, Coubron, both of France

[73] Assignee: L'Oreal, Paris, France

[21] Appl. No.: 301,703

[22] Filed: Sep. 7, 1994

[30] Foreign Application Priority Data

Sep. 10, 1993 [FR] France ..... 93 10774

[51] Int. Cl.[6] ..... B65D 35/28

[52] U.S. Cl. ..... 222/1; 222/95; 222/387; 222/389

[58] Field of Search ..... 222/1, 95, 105, 222/387, 389, 401

[56] References Cited

U.S. PATENT DOCUMENTS

| | | | |
|---|---|---|---|
| 3,112,846 | 12/1963 | Hein | 222/389 X |
| 3,179,309 | 4/1965 | Cope | 222/389 |
| 4,844,301 | 7/1989 | Juillet | 222/389 X |
| 5,318,204 | 6/1994 | Davis et al. | 222/105 X |

FOREIGN PATENT DOCUMENTS

| | | | |
|---|---|---|---|
| 0338844 | 10/1989 | European Pat. Off. | 222/401 |
| 973108 | 2/1951 | France. | |
| 3934237 | 2/1990 | Germany . | |
| 5-254575 | 10/1993 | Japan | 222/389 |

*Primary Examiner*—Andres Kashnikow
*Assistant Examiner*—Kenneth Bomberg
*Attorney, Agent, or Firm*—Young & Thompson

[57] ABSTRACT

Method and device for packaging and dispensing a fluid product (P) contained in a receptacle (2) which is pressurized with the aid of a propellant gas (G), the receptacle (2) including two compartments (3, 4) which are separated by a moving partition (5), a first compartment (3) containing the fluid product (P) and being in communication with a valve (6) for dispensing the product (P) and the second compartment (4) containing the propellant gas (G), by which in the second compartment (4) the propellant gas (G) is brought to a pressure P1 allowing the fluid product (P) to be dispensed by action on the dispensing valve (6), dispensing is carried out and the pressure in the second compartment (4) is lowered to atmospheric pressure, the pressure in the compartment (4) not being brought back up to a pressure allowing dispensing of the product (P) until just before the next dispensing act.

10 Claims, 2 Drawing Sheets

METHOD AND DEVICE FOR DISPENSING AND PACKAGING A FLUID PRODUCT CONTAINED IN A RECEPTACLE WHICH IS PRESSURIZED WITH THE AID OF A PROPELLANT GAS

FIELD OF THE INVENTION

The present invention relates to a method and device for dispensing and packaging a fluid product contained in a receptacle which is pressurized with the aid of a propellant gas, more particularly advantageous when the propellant gas is not compatible with the fluid product to be dispensed, as well as to a device for the implementation of the said method.

According to the present invention, a fluid product is understood to be a product in the form of a liquid or in the form of a paste or cream with some degree of viscosity.

BACKGROUND OF THE INVENTION

It is known to use, for packaging and dispensing a fluid product contained in a receptacle which is pressurized using a gas which is not compatible with the fluid product, a receptacle including two compartments which are separated by a moving partition, a first compartment containing the fluid product and being in communication with a valve for dispensing the product, and a second compartment containing the compressed gas. During dispensing, the moving partition moves and/or deforms. The moving partition may be made up of a deformable membrane; it is preferably made up of a piston. This type of device is intended to isolate the fluid product to be dispensed from the propellant gas and thus delay the deterioration of the fluid product by the propellant gas.

However, the moving wall, more particularly when it is made up of a piston, is not always absolutely leaktight either because the seals between the moving wall and the receptacle are not leaktight, or because the moving wall has a certain permeability to the propellant gas. The lower the viscosity of the fluid product and the higher the pressure of the compressed gas in the second compartment, the poorer the sealing. Consequently, during storage, the compressed gas may leak progressively into the first compartment containing the fluid product and this product may be deteriorated after a certain storage time. This problem arises, for example, in the case where the compressed gas is air and where the fluid product is a hair dye.

SUMMARY OF THE INVENTION

According to the present invention, it has been found that it is possible to avoid deterioration of a fluid product, even one of low viscosity, by an incompatible propellant gas in a receptacle which is separated into two compartments by a moving partition, even though the seal between the wall of the receptacle and the moving partition is not strictly leaktight and/or even though the moving partition has a certain permeability, by keeping the propellant gas in the second compartment at atmospheric pressure during storage and increasing the pressure in the said second compartment only in order to allow the said dispensing, the receptacle being pressurized only for a very short length of time close to the dispensing time.

One subject of the present invention is therefore a method for packaging and dispensing a fluid product contained in a receptacle which is pressurized with the aid of a propellant gas, the receptacle including two compartments which are separated by a moving partition, a first compartment containing the fluid product and being in communication with a valve for dispensing the product and the second compartment containing the propellant gas, characterized in that in the second compartment the propellant gas is brought to a pressure having a value P1 allowing the fluid product to be dispensed by action on the dispensing valve, that dispensing is carried out and that the pressure in the second compartment is lowered to atmospheric pressure, the pressure not being brought back up to a pressure allowing dispensing of the product until just before the next dispensing act.

The propellant gas is a compressed gas, preferably air. In order to bring the compartment containing the propellant gas to a pressure allowing dispensing, the propellant gas, particularly compressed air, is preferably introduced with the aid of a compressor or of some other source of compressed gas by means of a valve located in the wall of the compartment containing the propellant gas. The compressor used may, for example, be the one described in FR-A 2,656,047.

In order to return the pressure of the second compartment to atmospheric pressure after a dispensing act, a leakage is advantageously formed between the second compartment and the atmosphere. It is possible to form this leakage after or during dispensing. In the latter case, during the operation of pressurizing the gas compartment, the pressure is brought to the value P1 which is greater than atmospheric pressure and allows dispensing by actuation of the dispensing valve and the leakage flow rate of the propellant gas is chosen such that a sufficient dispensing time is available. In practice, it is considered that a dispensing time of 1 to 10 minutes is suitable in the case of the dispensing of cosmetic products.

Another subject of the present invention is a device allowing the implementation of the method according to the invention; a device for packaging and dispensing a fluid product including a receptacle which is pressurized with the aid of a propellant gas, the receptacle including two compartments which are separated by a moving partition, the first compartment containing the fluid product to be dispensed and communicating with a dispensing valve carried by the receptacle and the second compartment containing the propellant gas, is characterized in that the wall of the second compartment carries a valve for feeding with compressed propellant gas and has a leakage orifice allowing the propellant gas to leak into the atmosphere.

The leakage orifice may include a closure means allowing the said orifice to be closed during the pressurizing step and/or the dispensing step. This closure means is, for example, a stopper which the user fits manually.

Preferably, the leakage orifice does not include any closure means; it may be independent of the valve for feeding with propellant gas and it is then advantagously made up of a micro-orifice pierced in the wall of the second compartment. Preferably, the leakage orifice forms part of the valve for feeding with compressed propellant gas. For example, according to the latter embodiment, the valve for feeding with compressed propellant gas is a valve with a shut-off element, in which the shut-off element does not close back down onto its seat in a leaktight fashion in the closed position when the feeding with propellant gas has ended. The leakage orifice is then made up of the space existing between the shut-off element and its seat. According to a preferred embodiment, the valve is made up of a shut-off element of elastic material resting on a seat and a slender groove is formed in the seat and/or the shut-off element so as to create a leakage orifice between the shut-off element and its seat in the closed position. The latter embodiment is advantageous because there is no leakage of compressed propellant gas during the pressurizing phase.

BRIEF DESCRIPTION OF THE DRAWINGS

To make the invention easier to understand, there will be described hereafter, merely by way of illustration and with no limitation implied, two embodiments thereof which are represented in the appended drawing.

In this drawing.

DETAILED DESCRIPTION OF THE INVENTION

Figure 1:
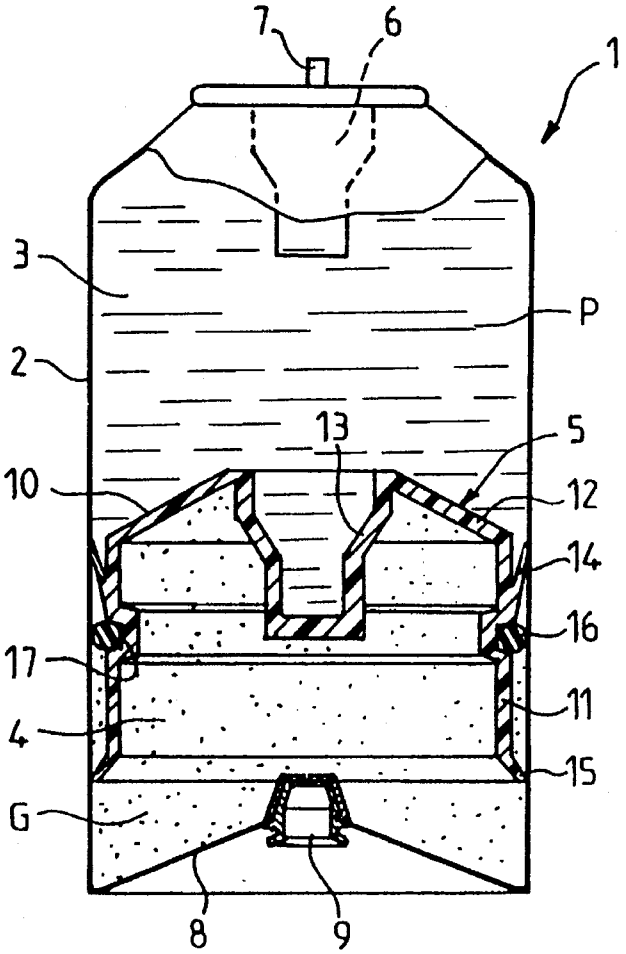
FIG. 1 is a view partially in section of a first embodiment of a device according to the invention.

In FIG. 1, the device according to the invention is denoted overall by the reference 1. The device 1 is made up of a receptacle 2 divided into two compartments 3 and 4 by a moving partition made up of a piston 5. The first compartment 3 contains the product P to be dispensed and the second compartment 4 contains the propellant gas G. A dispensing valve 6 is crimped onto the receptacle 2, communicates with the compartment 3 and carries a stem 7 which can be driven in with the aid of a push button (not represented) in order to actuate the valve 6 and dispense the product P. According to the embodiment represented, the end 8 of the receptacle 2 forms a dish of conical shape having its concavity pointing outwards and it is equipped at its centre with a valve 9 forming a stopper which will be described in more detail hereafter.

The piston 5 includes a transverse element 10 carrying a cylindrical skirt 11 pointing towards the second compartment 4. The transverse element 10 peripherally has a conical portion 12, of which the convexity points towards the compartment 3 and which at its centre joins onto an indentation 13 pointing towards the compartment 3. In the example represented, this indentation 13 is formed of lateral walls which are successively cylindrical, frustoconical and cylindrical, and of an end perpendicular to the axis of the receptacle 2; thus, the indentation 13 has a shape which complements that of the valve 6.

The cylindrical skirt 11 of the piston 5 is equipped with two sealing lips: a first lip 14 located in the vicinity of the transverse element 10 and pointing towards the compartment 3, and a second lip 15 situated at the open end of the skirt 11 and pointing towards the end 8 of the receptacle 2. An O-ring seal 16 is located, in a groove 17 in the skirt 11, between the lips 14 and 15.

The valve 9 is made up of two components fitting into one another: a membrane 18 made of elastic material forming a shut-off element and a body 19 made of a rigid plastic forming the seat of the shut-off element. The elastic membrane 18 includes a frustoconical lateral wall 20, of which the end of larger diameter bears a groove 27 allowing the said elastic membrane 18 to be snap-fitted onto the end 8 of the receptacle 2. At the smaller-diameter end of its lateral wall 20, the elastic membrane 18 is extended as a transverse component 21 including an axial orifice 22.

The rigid body 19 has a shape which complements that of the elastic membrane 18 and therefore includes a frustoconical lateral wall 25 extended as a transverse component 26. In the frustoconical wall 25 there is formed a duct 23 which is parallel to the axis of the valve 9 and opens out in the vicinity of the junction between the frustoconical wall 25 and the transverse component 26. The larger-diameter end of the frustoconical wall 25 extends as a cylindrical wall 30 equipped with an annular collar 28 which, together with the frustoconical wall 25, defines a neck 31 receiving the large-diameter end of the frustoconical wall 20 of the elastic membrane 18: thus, when the rigid body 19 is fixed to the end 8 of the receptacle 2, the elastic membrane 18 acts as a seal; an annular collar 29 formed at the lower part of the body 19 allows the valve 9 to be fitted to a gas compressor (not represented). On the outer surface of the body 19 there is formed a groove 24 which, when the rigid body 19 and the membrane 18 are assembled, places the orifice 22 and the duct 23 in communication.

The device 1 operates in the way described below. When the user wishes to dispense the product P contained in the compartment 3 of the receptacle 2, he places the receptacle 2 on a gas compressor (not represented), particularly an air compressor, so that the valve 9 is in communication with the delivery nozzle of the compressor. The compressed gas G passes through the duct 23, deforms the elastic membrane 18, detaching it from the body 19, and penetrates into the compartment 4 via the orifice 22. It should be noted that the groove 24, although it allows a certain amount of propellant gas G to pass, would not by itself allow the compartment 4 to be fed with gas G in a short period of time: the pressure in the compartment 4, which was equal to atmospheric pressure, increases. Pressurization continues until the pressure reaches a predetermined value P1, sufficient to allow the product to be dispensed when the dispensing valve 6 is actuated. The user then halts the feeding with compressed gas G and separates the receptacle 2 from the compressor.

The elastic membrane 18, under the action of this pressure P1, reassumes its position of rest on the rigid body 19: the groove 24 places the orifice 22 and the duct 23 in communication and allows a small leakage of propellant gas G from the compartment 4 into the atmosphere through the duct 23. Shortly after having removed the receptacle 2 from the compressor, the user actuates the valve 6 and dispenses the product P contained in the compartment 3. The piston 5 moves longitudinally in terms of translation towards the valve 6 despite the slight leakage of propellant gas G via the valve 9. Owing to the movement of the piston and the slight leakage of propellant gas G, the pressure in the compartment 4 decreases. The dimensions of the groove 24 are chosen so that the leakage flow rate of the propellant gas G is such that dispensing can last from 1 to 10 minutes. When dispensing has stopped or been halted, the user having stopped actuating the valve 6, the pressure inside the compartment 4 continues to decrease progressively until it reaches atmospheric pressure by virtue of the groove 24 in the valve 9. The user will not reestablish a pressure P1 in the compartment 4 until he wishes to dispense some product again.

Under these conditions, the device 1 is pressurized only for a few minutes at the moment of use. What is more, when the propellant gas G is compressed air, the device 1 is not heat-sensitive and there is no danger of it exploding. Furthermore, it is ecological, the gas discharged into the atmosphere being air.

Figure 2:
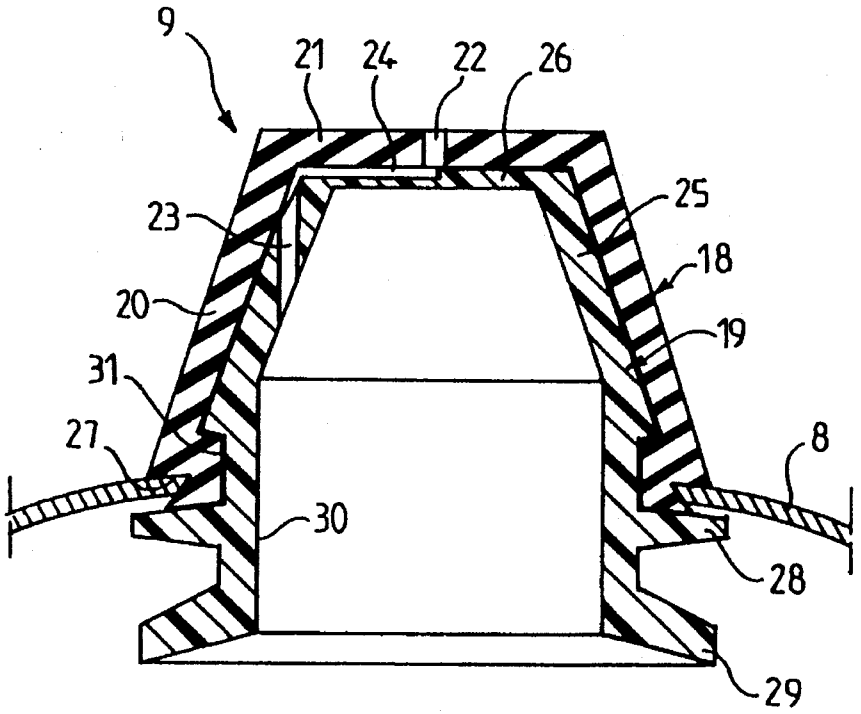
FIG. 2 is a detailed view of the valve for feeding the device of FIG. 1 with gas.
Figure 3:
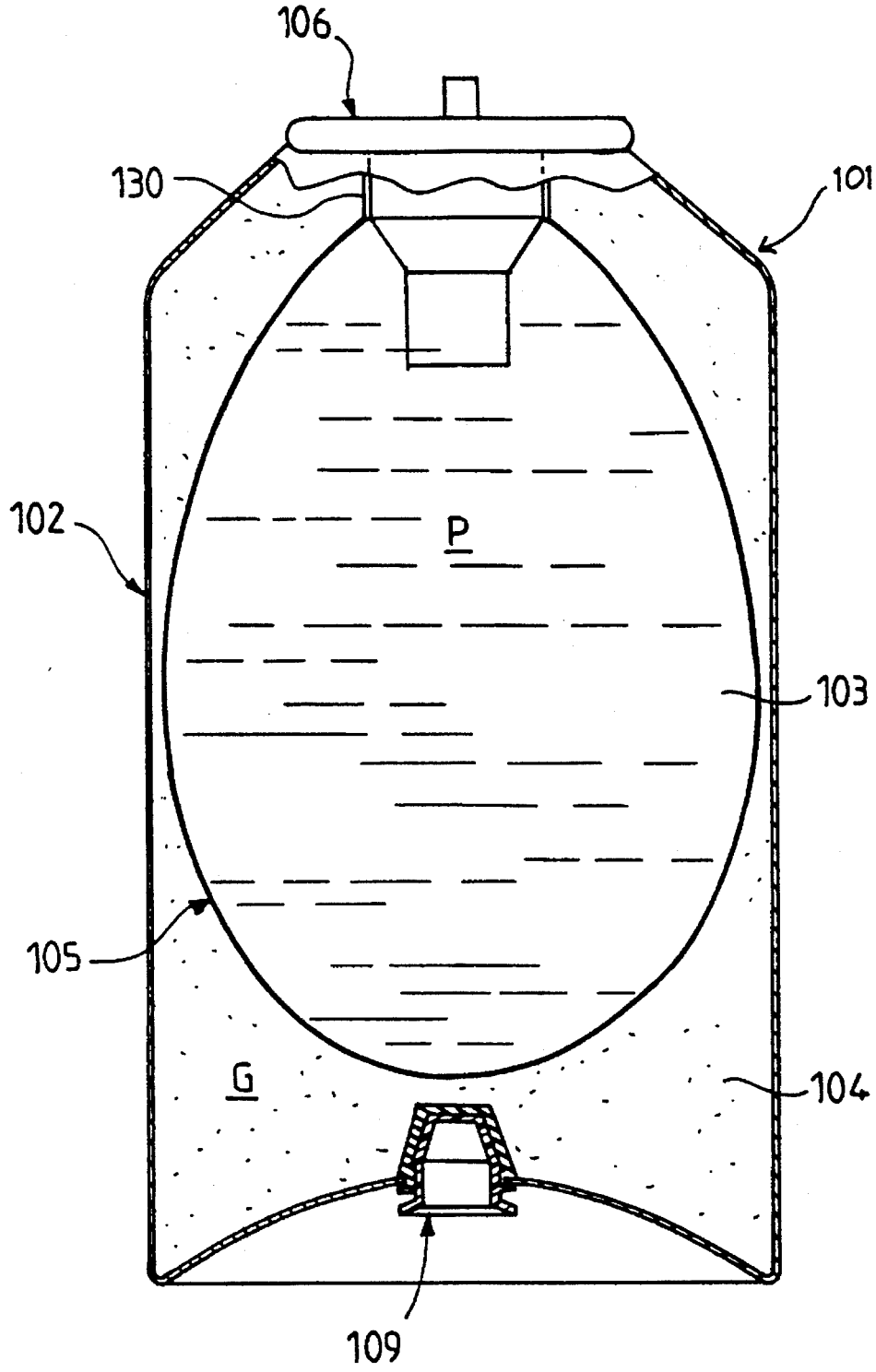
FIG. 3 is a view partially in section of a second embodiment of a device according to the invention.

FIG. 3 represents a second embodiment of a device according to the invention denoted overall by the reference 101. This device 101 includes a receptacle 102 separated into two compartments: a compartment 103 containing the product P to be dispensed, and a compartment 104 containing the compressed gas G. These two compartments are separated by a moving partition 105 which is made up of a deformable pouch. The end of the receptacle 102 is equipped with a valve 109 identical to the one illustrated in FIG. 2. On the opposite side from the end of the receptacle carrying the valve 109 there is crimped a dispensing valve 106 which communicates with the compartment 103 containing the product P to be dispensed. The deformable pouch 105 is fastened, for example by a weld 130, to the body of the valve 106.

In this device, a pressure P allowing dispensing is not established in the compartment 104 until the moment of dispensing, the pressure in the compartment 104 then returning to atmospheric pressure. Consequently, even if the walls of the pouch 105 are slightly permeable to the gas, the gas will have practically no tendency to pass through the wall of the pouch and the risks of the product P contained in the pouch deteriorating are low.

We claim:

1. In a method for packaging and dispensing a fluid product (P) contained in a receptacle (2,102) which is pressurized with the aid of a propellant gas (G), the receptacle (2, 102) including two compartments (3, 103; 4, 104) which are separated by a moving partition (5, 105), a first of said two compartments (3, 103) containing the fluid product (P) and being in communication with a valve (6, 106) for dispensing the product (P) and the second of said two compartments (4, 104) containing the propellant gas (G); the improvement comprising bringing the propellant gas (G) in the second compartment (4, 104) to a pressure P1 allowing the fluid product (P) to be dispensed by action on the dispensing valve (6), dispensing the fluid product (P), and lowering the pressure in the second compartment (4, 104) to atmospheric pressure by forming a leakage of propellant gas (G) between the second compartment (4, 104) and the atmosphere during and after the dispensing of the product, the leakage flow rate of the propellant gas (G) being chosen such that sufficient dispensing time is available, and bringing the pressure in the compartment (4, 104) back up to a pressure allowing further dispensing of the product (P) only just before a next dispensing act.

2. Method according to claim 1, characterized in that the propellant gas (G) is compressed air.

3. Method according to claim 1, characterized in that the dispensing time is from 1 to 10 minutes.

4. In a device for packaging and dispensing a fluid product (P) including a receptacle (2, 102) which is pressurized with the aid of a propellant gas (G), the receptacle (2, 102) including two compartments (3, 103 and 4, 104) which are separated by a moving partition (5, 105), a first of said two compartments (3, 103) containing the fluid product (P) to be dispensed and communicating with a dispensing valve (6, 106) carried by the receptacle (2, 102) and the second of said two compartments (4,104) containing the propellant gas (G), a wall of the second compartment (4, 104) carrying a filling valve (9, 109) for feeding the second compartment with compressed propellant gas (G); the improvement wherein the second compartment (4, 104) has a leakage orifice (22, 23, 24) communicating permanently between the interior of the second compartment and the atmosphere outside the device and which allows the propellant gas (G) to leak into the atmosphere.

5. Device according to claim 4, characterized in that the moving partition (5) is a piston.

6. Device according to claim 4, characterized in that the moving partition (105) is a deformable pouch.

7. Device according to claim 4, characterized in that the leakage orifice (22, 23, 24) forms part of the valve (9, 109) for feeding with compressed propellant gas

8. Device according to claim 7, characterized in that the filling valve (9, 109) for feeding with compressed propellant gas (G) is a valve with a shut-off element, in which the shut-off element does not rest on a seat in a leaktight fashion in a closed position.

9. Device according to claim 7, characterized in that the filling valve (9, 109) for feeding with compressed propellant gas (G) includes an elastic shutoff element interacting with a seat and a groove is formed in one of the shut-off elements and the seat so as to create the leakage orifice between the shut-off element and its seat in the closed position.

10. Device according to claim 9, characterized in that the shut-off element is made up of an elastic membrane (18) interacting with a rigid body (19) comprising said seat, the elastic membrane (18) being provided with an orifice (22) and the rigid body (19) being provided with a duct (23), a groove (24) being formed in the rigid body (19) so as to place the orifice (22) and the duct (23) in communication even when the valve is in the closed position.

* * * * *